United States Patent [19]

Brown et al.

[11] Patent Number: 4,768,010

[45] Date of Patent: Aug. 30, 1988

[54] LATCH AND PIVOT MECHANISM FOR ELECTRONIC SECTIONALIZER MOUNTING STRUCTURE

[75] Inventors: Robert A. Brown; Daren A. Clark, both of Centralia, Mo.

[73] Assignee: A. B. Chance Company, Centralia, Mo.

[21] Appl. No.: 95,548

[22] Filed: Sep. 11, 1987

[51] Int. Cl.[4] ..... H01H 71/20

[52] U.S. Cl. ..... 337/169; 337/177; 361/115

[58] Field of Search ..... 337/168, 169, 170, 171, 337/172, 173, 174, 175, 176, 177; 361/115

[56] References Cited

U.S. PATENT DOCUMENTS

| | | | |
|---|---|---|---|
| 3,321,721 | 5/1967 | Smith, Jr. | 335/32 |
| 3,611,240 | 10/1971 | Mikulecky | 337/169 |
| 4,546,341 | 10/1985 | McNaghten et al. | 337/177 |
| 4,553,188 | 11/1985 | Aubrey et al. | 361/115 |
| 4,636,764 | 1/1987 | Mee et al. | 337/169 |

*Primary Examiner*—H. Broome

*Attorney, Agent, or Firm*—Hovey, Williams, Timmons & Collins

[57] ABSTRACT

A pivot mechanism for drop-out of an electronic sectionalizer tube from an upper contact of mounting structure is arranged so that substantially the entire force released by an actuator fired by a sectionalizer logic circuit immediately causes the tube to drop away and disengage the upper contact. The actuator is mounted on a lower portion of the tube and has a pin that strikes a trunnion pivotally interconnecting a lower contact of the mounting structure and a lower portion of the tube, and the pin of the actuator strikes the trunnion at a location between the pivotal connections of the trunnion so that immediate, downwardly directed motion of the sectionalizer tube away from the upper contact is assured. The pivot mechanism reliably ensures successful drop-out of the tube regardless of adverse environmental conditions and with minimal reliance upon a spring or the effects of gravity.

12 Claims, 1 Drawing Sheet

LATCH AND PIVOT MECHANISM FOR ELECTRONIC SECTIONALIZER MOUNTING STRUCTURE

BACKGROUND OF THE INVENTION

1. Field of the Invention

This invention broadly relates to a pivot mechanism for an electronic sectionalizer which enables the sectionalizer to reliably drop out and away from an upper contact to disable a branch or lateral line from the rest of the power distribution network whenever a fault current is detected by the sectionalizer. More particularly, the present invention concerns a latch and pivot mechanism for drop out of the sectionalizer tube wherein an actuator is positioned between pivot points of a trunnion interconnecting the sectionalizer tube and the lower contacts so that upon firing of the actuator the sectionalizer tube immediately is urged in a downwardly direction away from the upper contact. A spring latch releasably retains the trunnion in a fixed location relative to the tube during normal operation when the branch line protected by the sectionalizer is energized, and the latch is arranged to immediately allow the trunnion to swing as soon as the actuator is fired while the sectionalizer tube begins its downward movement.

2. Description of the Prior Art

High voltage power distribution systems are typically comprised of a main supply line that is connected to a number of branch or lateral lines. Normally, the main line is protected near its source of power by an automatic recloser or a reclosing circuit breaker which is operable to disable the entire system downstream of the recloser if currents above a certain magnitude are detected. Automatic reclosers and reclosing circuit breakers are particularly useful for enabling transient fault currents to clear after which time the recloser can again actuate the circuit; however, if fault current conditions remain, the recloser after one or more attempts to re-energize the circuit will cease operation and cause the distribution system to remain in a de-activated state until attended by a repairman.

In the past, fuse links were often installed at the beginning of each lateral line to protect the line and isolate the same from the rest of the distribution system where over-current conditions existed only in a particular lateral line. Many problems were observed, however, in attempting to coordinate the opening characteristics of the fuse links with reclosing apparatus and to ensure that the fuse link would not melt and open the lateral line before the reclosing apparatus had an opportunity to deactivate the entire system. As a consequence, electronic sectionalizers were developed which instead count the number of times that the recloser opens and closes the circuit. After a specified number of opening and closing cycles or "shots" the electronic sectionalizer disables the lateral line during a subsequent period when the reclosing apparatus has opened if over-current conditions in the lateral line protected by the sectionalizer are detected. For additional disclosure of electronic sectionalizers, reference is hereby made to U.S. Pat. No. 4,553,188 dated Nov. 12, 1985.

Normally, it is desirable for an electronic sectionalizer to be physically interchangeable with conventional electrical cutouts so that the sectionalizer can be easily retrofitted and installed in the mounting structure originally provided to hold the cutout. Consequently, sectionalizers often include an elongated tube assembly that has an upper electrical terminal releasably engageable with the upper contact of the mounting structure, and other type of pivot mechanism that is received on the lower contacts of the mounting structure. The sectionalizer typically includes a chemical actuator or some type of striking device that is fired by a logic circuit of the sectionalizer once the latter has determined that over-current conditions still exist in the lateral line protected by the sectionalizer after one or more cycles of operation of the reclosing apparatus.

The pivot mechanism of many sectionalizers, as for example those illustrated in the aforementioned U.S. Pat. No. 4,553,188 cooperates with a latch that is released or opened by the actuator. That is, the actuator, once fired, causes a latch or release lever to swing, and thereafter a spring and/or the forces of gravity are utilized to complete the pivotal movement and ensure that the sectionalizer tube shifts downwardly away from the upper contact to open the lateral line. Thus, the force exerted by the actuator in such devices does not directly impart movement of the tube toward an isolating position, but merely moves a latch so that either a spring or the force of gravity is subsequently operable to urge the tube to fall away from the upper contact.

In other known devices, such as is illustrated in U.S. Pat. No. 4,636,764, a pivot mechanism in the form of an over-center toggle arrangement is provided which causes the sectionalizer tube to be held in an over-center position when loaded in its normal, current carrying orientation. A toggle lever pivotally connected to the sectionalizer tube moves the same over-center once an actuator carried by the lever is activated. However, much of the force of the actuator is directed toward overcoming the spring-loaded upper contact of the mounting structure which normally biases the tube toward its loaded, over-center orientation. As a consequence, once the actuator is fired to shift the tube over-center, the actuator has relatively little available energy remaining, thereby reducing the likelihood that the lever has sufficient momentum to continue to swing and cause the tube to drop away from the upper contact.

As can be appreciated, sectionalizers which are installed on cut-out mountings are typically exposed to adverse environmental conditions and normally the pivot mechanism is held in a stationary position for extended periods of time. Thus, the pivotal joints of the mechanism are subject to corrosion and ice which may prevent successful drop-out of the sectionalizer tube. Therefore, there is a need for a latch and pivot sectionalizer mounting structure which reliably enables the sectionalizer tube to shift away from the contacts and thereby open the circuit whenever the actuator is activated.

SUMMARY OF THE INVENTION

The present invention is directed toward a pivot mechanism for an electronic sectionalizer that overcomes the problems noted above with regard to conventional sectionalizer drop-out mechanisms. In particular, the pivot mechanism as disclosed herein is constructed so that the sectionalizer tube immediately begins its downward drop-out motion simultaneous with firing of an actuator and causes the upper terminal of the sectionalizer tube to reliably drop away from the upper contact. Moreover, all of the force exerted by the actuator is directed upon a pivotal member or trunnion interconnecting the tube and the lower contact so that the forces imparted to the trunnion and the tube by the actuator function to successfully and reliably shift the sectionalizer tube toward its drop-out position.

In more detail, the pivot mechanism of our present invention is arranged so that the pivotal interconnection between the trunnion and the sectionalizer tube is spaced above a location where a lower pin of the trunnion is received in hook-like structure of the lower contact. The actuator is mounted on the sectionalizer tube assembly at a position between the upper and lower pivot points of the trunnion, whereby the force exerted by the actuator (which optionally may have a striking pin to contact the trunnion) is imparted to the trunnion at a location between the pivot points. In this manner, all of the force exerted by the actuator functions to shift the trunnion and the lower portion of the sectionalizer tube away from each other so that the tube immediately begins movement in a downward direction as soon as the actuator is fired.

In preferred embodiments, a spring latch fixed to a lower portion of the trunnion engages a shoulder of a casting forming a lower portion of a sectionalizer tube assembly, and the latch is operable to retain the position of the trunnion in fixed relationship to the tube when the latter is in its normal, loaded, current-carrying position. During firing of the actuator, however, the latch immediately disengages from the shoulder of the casting at the same time that movement of the trunnion is initiated to ensure successful drop-out of the sectionalizer tube assembly from the contacts of the mounting structure.

DETAILED DESCRIPTION OF THE DRAWINGS

Figure 1:
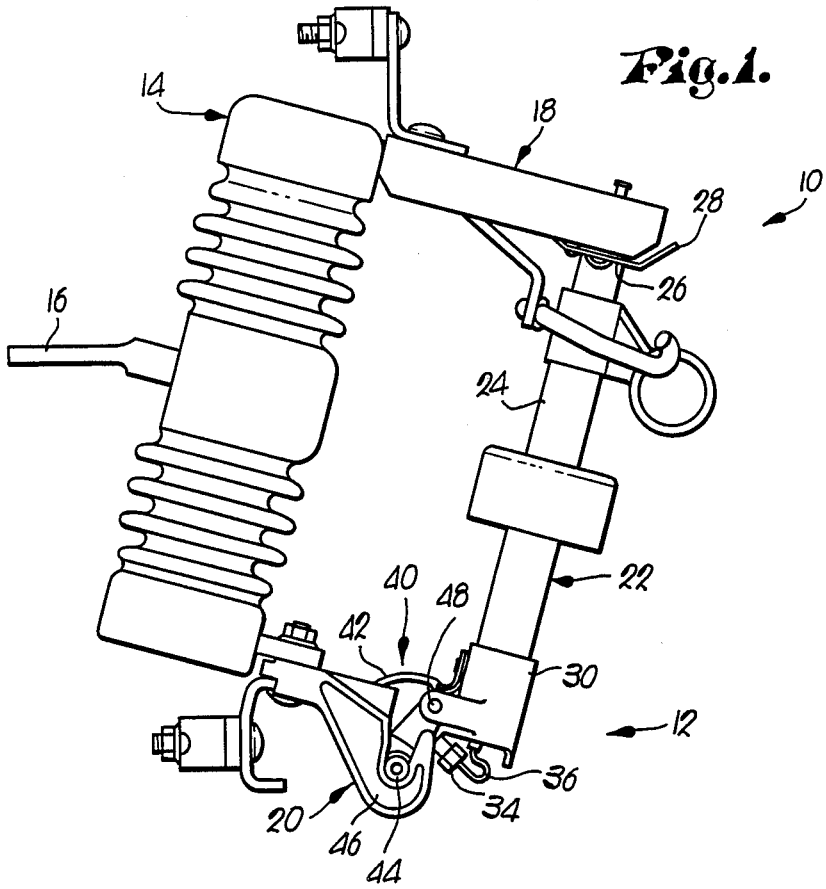
FIG. 1 is a side elevational view of a sectionalizer assembly showing upper and lower contacts of mounting structure, a sectionalizer tube in engagement with the upper contact, and a latch and pivot mechanism constructed in accordance with the present invention for releasably retaining the sectionalizer tube in a loaded, current-carrying position.

A sectionalizer assembly, broadly designated by the numeral 10, is depicted in FIG. 1 and includes an insulator 14 having an arm 16 for mounting the assembly 10 on the pole. The assembly 10 includes mounting structure 12 that comprises an upper electrical contact and a lower electrical contact broadly designated 18, 20 respectively.

A sectionalizer tube assembly 22 includes an upright, electrically conductive tube 24 having an upper electrical terminal 26 with a frustroconical portion in releasable engagement with a concave, semi-hemispherical detent formed in a conductive arm 28 of the upper contact 18. The arm 28 is biased downwardly by a compression spring and is described in more detail, along with other components of the upper contact 18, in U.S. Pat. No. 4,546,341 dated Oct. 8, 1985 and owned by the assignee of the present invention.

A lower tube casting 30 of the assembly 22 is mounted on the lower portion of tube 24 and includes a leg 32 (see FIGS. 2 and 3) extending toward insulator 14. A generally cylindrical-shaped actuator 34 is mounted within a threaded bore of leg 32 and is connected by leads 36 that extend through tube 24 to a logic circuit 38.

A pivot mechanism 40 interconnects the tube assembly 22 and the lower electrical contact 20 of mounting structure 12. The pivot mechanism 40 includes a member or trunnion 42 having a pair of oppositely oriented, outwardly extending pins 44 received in respective U-shaped or hook-shaped portions 46 of the lower electrical contact 20 which are disposed on each side of the trunnion 42. For a better understanding of the lower electrical contact 20 and the trunnion 42, reference is again made to the aforementioned U.S. Pat. No. 4,546,341.

A pin 48 functions as a means for pivotally connecting the trunnion 42 to the tube assembly 22. As shown best in FIG. 2, a spring contact 50 secured to the lower tube casting 30 normally engages a raised portion of the trunnion 42 above pin 48 when the sectionalizer tube assembly 22 is in its current-carrying or loaded position, to enable current to flow from the upper electrical contact 28, along the length of conductive tube 24 and thereby across the trunnion 42 to the hook-shaped portions 46 of the lower electrical contact 20.

Figure 2:
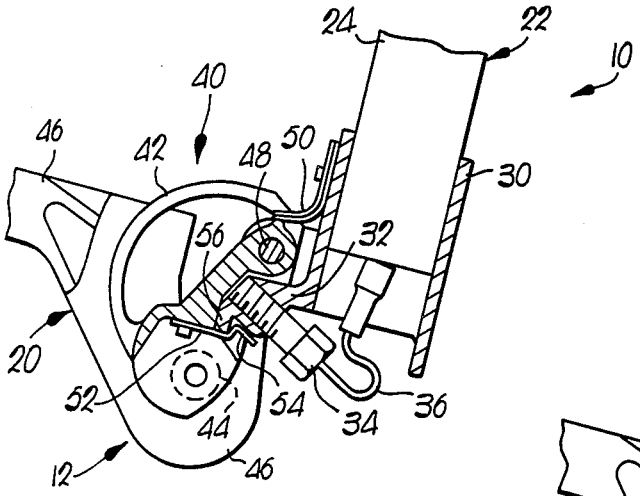
FIG. 2 is a fragmentary, enlarged, side cross-sectional view of the latch and pivot mechanism shown in FIG. 1 along with a lower portion of the sectionalizer tube and components of the lower contact.
Figure 3:
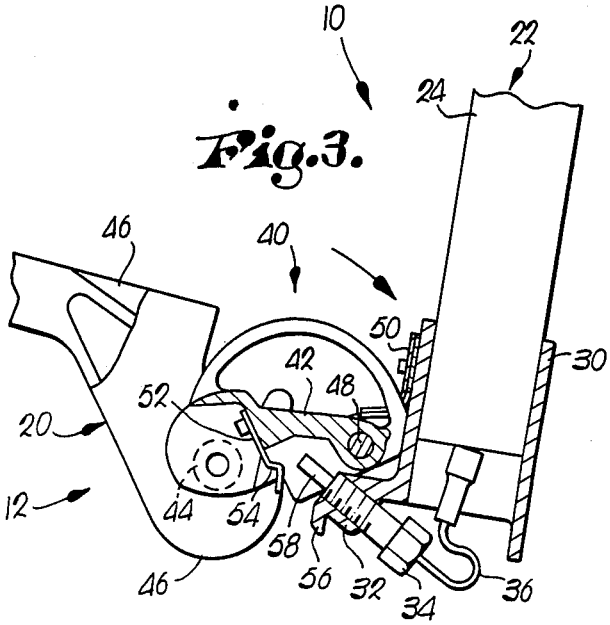
FIG. 3 is a view somewhat similar to FIG. 2 but showing the position of a trunnion of the latch and pivot mechanism and a lower portion of the sectionalizer tube during drop-out of the latter once an actuator is fired by a logic circuit of the sectionalizer.

A spring latch 52, as shown in FIGS. 2 and 3, is fixed to a lower portion of the trunnion 42 and has a laterally extending section or catch 54 that is received around a square corner 56 formed in the lower tube casting 30 beneath actuator 34. Normally, the latch 52 precludes relative movement between the trunnion 42 and the sectionalizer tube assembly 22 so that the latter remains in its loaded or current-carrying orientation.

If logic circuit 38 determines that over-current conditions exist in the lateral line protected by the sectionalizer assembly 10, the logic circuit 38 detonates actuator 34 causing a pin 58 (FIG. 3) to be immediately released from the interior of the actuator 34. The pin 58 shifts upwardly in an inclined direction along the central axis of actuator 34 and immediately impacts the trunnion 42 at a location between the pivotal connections, or more specifically, at a position between pins 44 and pin 48. The force of the actuator 34 is such as to cause the spring latch 52 to readily deflect downwardly around the shoulder 56 and enable the trunnion 42 to continue its rotative motion in an arc is illustrated by the arrow in FIG. 3.

The actuator 34, once fired, immediately swings the trunnion 42 about the pin 48 and simultaneously causes trunnion 42 to swing relative to the hook-shaped portions 46 of the lower electrical contact 20. As can be appreciated by comparison of FIGS. 2 and 3, the arrangement of the actuator 34 between the two pitoval connections, or pins 44, 48 interconnecting the trunnion 42 and the tube 24 and contact 20, ensures that the sectionalizer tube assembly 22 immediately shifts downwardly and away from the upper electrical contact 18 as soon as the actuator 34 is fired. All of the force exerted by the actuator 34 is directed to the trunnion 42, causing the latter to spread away from the lower tube casting 30 and thereby cause instantaneous downward movement of the tube 24.

Substantially all of the energy released by actuator 34 initiates swinging movement of the trunnion 42 simultaneously with downward shifting motion of the tube 24 away from the upper electrical contact 18, to reliably ensure that the actuator force is sufficient for drop-out of the tube 24 even in adverse environmental conditions. Downward movement of the tube 24 is effected as soon as the actuator 34 is detonated, which downward movement is facilitated by the bias exerted by the compression spring of the upper electrical contact 18 as well as by the forces of gravity exerted on assembly 22.

From the foregoing, it can be appreciated that the present invention provides an especially effective means for reliably ensuring drop-out of an electronic sectionalizer, since none of the actuator force is utilized to overcome the spring bias of upper contact 18, and substantially all of the energy of actuator 34 is instead used to initiate immediate downward motion of tube 24. However, various additions or modifications may be made to our currently preferred embodiment without departing from the gist and essence of our contribution to the art. As an example, the detonating actuator 34 may be replaced by a solenoid-type actuator that can be reset after drop-out of the sectionalizer tube 24 to thereby avoid the necessity of replacing the actuator 34. As a consequence, the invention should be deemed to be limited only by a fair scope of the claims which follow.

We claim:

1. A sectionalizer assembly comprising:

mounting structure including an upper electrical contact and a lower electrical contact spaced from said upper contact;

an upright tube assembly having an upper electrical terminal in releasable engagement with said upper contact;

a pivot mechanism interconnecting said tube assembly and said lower contact, said mechanism including a member pivotally coupled to said lower contact and means pivotally connecting said member to said tube assembly for swinging movement of said member relative to said tube assembly during simultaneous pivoting of said member relative to said lower contact, latch means normally retaining said member in fixed relation relative to said tube assembly; and an actuator for selectively moving said member relative to said tube assembly, said actuator being mounted on one of said tube assembly and said member and being operable to exert a force directly onto the other of said tube assembly and said member to urge said tube assembly and said member away from each other, said actuator being positioned below said pivotal connecting means and above the location where said member is pivotally coupled to said lower contact to thereby enable the force exerted by actuator to immediately initiate downward movement of said tube assembly as said member pivots relative to said tube assembly and to said lower contact for immediate drop-out of said tube assembly from said upper contact.

2. The invention as set forth in claim 1, wherein said actuator is mounted on a lower portion of said tube assembly and includes a pin releasable to strike said member.

3. The invention as set forth in claim 1, wherein said latch means comprises a spring latch affixed to said member and having a catch releasably engageable with a shoulder of said tube assembly.

4. The invention as set forth in claim 3, wherein said latch is located beneath said actuator in general vertical alignment therewith.

5. The invention as set forth in claim 1, wherein said lower electrical contact comprises a pair of hook-shaped portions, and said member includes a pair of outwardly extending pins received in a respective one of said hook-shaped portions.

6. The invention as set forth in claim 5, wherein said pins extend in a generally horizontal direction, and said actuator is mounted on said tube assembly for exerting a force on said member in an upwardly inclined direction.

7. The invention as set forth in claim 1, wherein said upper electrical contact of said mounting structure yieldably biases said tube assembly in a downwardly direction.

8. The invention as set forth in claim 1; and including a spring contact affixed to said tube assembly and engageable with said member for facilitating the conduction of current between said tube assembly and said member.

9. A sectionalizer assembly comprising:

mounting structure including an upper electrical contact and a lower electrical contact spaced from said upper contact;

an upright tube assembly having an upper electrical terminal in releasable engagement with said upper contact;

a pivot mechanism interconnecting said tube assembly and said lower contact, said mechanism including a member pivotally coupled to said lower contact and means pivotally connecting said member to said tube assembly for swinging movement of said member relative to said tube assembly during simultaneous pivoting of said member relative to said lower contact;

actuator means mounted on one of said tube assembly and said pivot mechanism and having means for exerting a force directly onto the other of said tube assembly and said pivot mechanism for initiating swinging movement of said member; and releasable latch means normally retaining said tube assembly and said member in a loaded position with said pivotal connecting means lying in non-over center relation relative to a reference line extending between the location where said member is pivotally coupled to said lower contact and the location where said upper electrical terminal of said tube assembly is in releasable engagement with said upper contact, said actuator means having structure for releasing said latch means to thereby cause immediate downward movement of said tube assembly as said member pivots relative to said tube assembly and said lower contact.

10. The invention as set forth in claim 9, wherein said latch means comprises an elonaged, laterally deflectable spring latch.

11. A sectionalizer assembly comprising:

mounting structure including an upper electrical contact and a lower electrical contact spaced from said upper contact;

an upright tube assembly having an upper electrical terminal in releasable engagement with said upper contact;

a pivot mechanism interconnecting said tube assembly and said lower contact, said mechanism including a member pivotally coupled to said lower contact and means pivotally connecting said member to said tube assembly for swinging movement of said member relative to said tube assembly during simultaneous pivoting of said member relative to said lower contact;

actuator means mounted on one of said tube assembly and said pivot mechanism and having means for exerting a force directly onto the other of said tube assembly and said pivot mechanism for initiating swinging movement of said member; and a spring latch coupled to one of said pivot mechanism and said tube assembly and releasably engageable with the other of said pivot mechanism and said tube assembly, said latch being of sufficient strength for normally retaining said tube assembly and said member in a loaded position with said pivotal connecting means lying in non-overcenter relation relative to a reference line extending between the location where said member is pivotally coupled to said lower contact and the location where said upper electrical terminal of said tube assembly is in releasable engagement with said upper contact, said actuator means having structure for overcoming the strength of said latch for immediate downward movement of said tube assembly as said member pivots relative to said tube assembly and to said lower contact.

12. The invention as set forth in claim 9, wherein said latch is elongated and laterally deflectable during release from said other of said upright tube assembly and said pivot mechanism.

* * * * *